United States Patent [19]

Grier et al.

[11] Patent Number: 4,771,613

[45] Date of Patent: Sep. 20, 1988

[54] SAFE HOLD

[76] Inventors: Mildred Grier, 230 Grant Ave., Chesilhurst, N.J. 08089; George Spector, 233 Broadway RM 3815, New York, N.Y. 10007

[21] Appl. No.: 79,797

[22] Filed: Jul. 30, 1987

[51] Int. Cl.[4] ..... A44C 7/00

[52] U.S. Cl. ..... 63/12; 24/107

[58] Field of Search ..... 63/12, 13; 24/107, 108, 24/90 R

[56] References Cited

U.S. PATENT DOCUMENTS

| | | | |
|---|---|---|---|
| 3,563,056 | 2/1971 | Noel | 63/12 |
| 3,630,048 | 12/1971 | Masters | 24/108 |
| 4,630,452 | 12/1986 | Connelly | 63/12 |
| 4,682,477 | 7/1987 | Vailoncourt | 63/12 |

FOREIGN PATENT DOCUMENTS

| | | | |
|---|---|---|---|
| 56314 | 11/1912 | Austria | 24/108 |
| 2581520 | 11/1985 | France | 63/12 |
| 2149646 | 6/1985 | United Kingdom | 63/12 |

OTHER PUBLICATIONS

Jeweler' Circular-Keystone p. 76, Dec. 1985, Clouet advertisement.

*Primary Examiner*—Richard J. Johnson

[57] ABSTRACT

A device for preventing loss of a pierced earring from an ear lobe is provided and consists of a holder member which will cling to friction post behind the ear lobe. When the friction nut is removed from the earring the holder member will continue to keep the earring in place thereto.

1 Claim, 1 Drawing Sheet

SAFE HOLD

BACKGROUND OF THE INVENTION

The instant invention relates generally to pierced earrings and more specifically it relates to a device for preventing loss of a pierced earring from an ear lobe.

Numerous pierced earrings have been provided in prior art that often become lost when their friction nuts that hold them in space becomes loose and falls off. While these units may be suitable for the particular purpose to which they address, they would not be as suitable for the purposes of the present invention as heretofore described.

SUMMARY OF THE INVENTION

A primary object of the present invention is to provide a device for preventing loss of a pierced earring from an ear lobe that will overcome the shortcomings of the prior art devices.

Another object is to provide a device for preventing loss of a pierced earring from an ear lobe that includes a rubber holder member which will cling to the friction post behind the ear lobe when the friction nut is removed thus holding the earring in place thereto.

An additional object is to provide a device for preventing loss of a pierced earring from an ear lobe in which the friction nut is held captive by the rubber holder member to prevent its loss therefrom.

A further object is to provide a device for preventing loss of a pierced earring from an ear lobe that is simple and easy to use.

A still further object is to provide a device for preventing loss of a pierced earring from an ear lobe that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
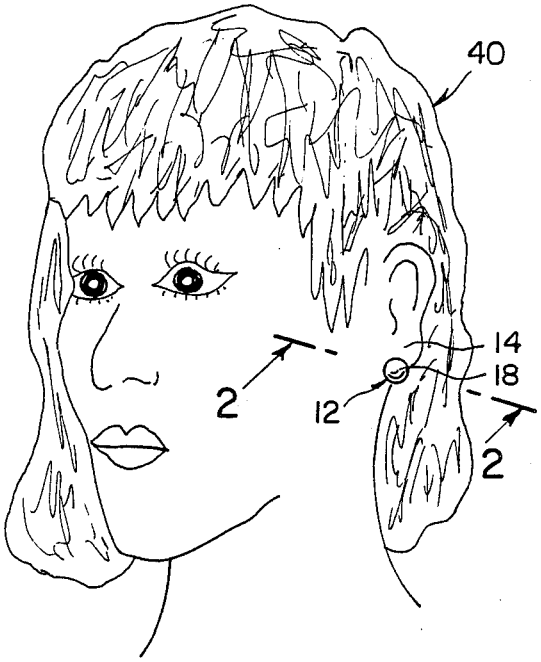
FIG. 1 is a perspective view of a person's head wearing a pierced earring with the invention attached thereto.
Figure 2:
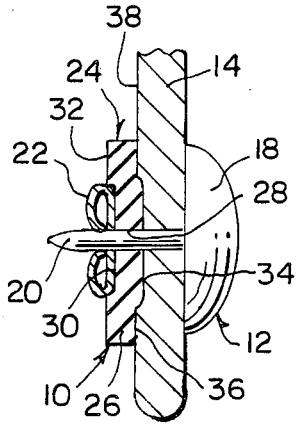
FIG. 2 is a cross sectional view taken along line 2—2 in FIG. 1.
Figure 3:
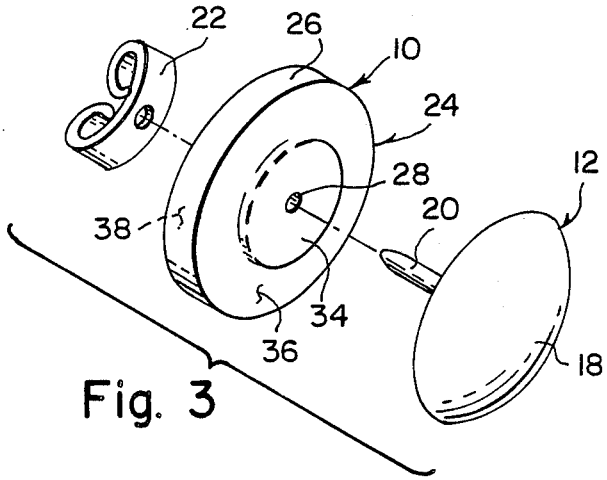
FIG. 3 is an exploded perspective view removed from the ear lobe.

Turning now descriptively to the drawings, in which similar reference characters denote similar elements throughout the several views, FIGS. 1 through 3 illustrate a device 10 for preventing loss of a pierced earring 12 from an ear lobe 14. The pierced earring 12 is of the type that has an ornament 18, friction post 20 and friction nut 22. The device 10 consists of a holder member 24 placed onto the friction post 20 between the friction nut 22 and the ear lobe 14. The holder member 24 will cling to the friction post 20 when the friction nut 22 is removed thus keeping the pierced earring 12 in place on the ear lobe 14.

The holder member 24 is a circular piece of foam rubber 26 that has a central aperture 28 therethrough to receive the friction post 20. A depression 30 is formed on rear surface 32 to receive the friction nut 22 and a raised portion 34 is formed on front surface 36 to increase engagement with rear surface 38 of the ear lobe 14. The holder member 24 is producible in a neutral beige color so as to be unobstrusive and blend with complexion of wearer 40 of the pierced earring 12.

Figure 4:
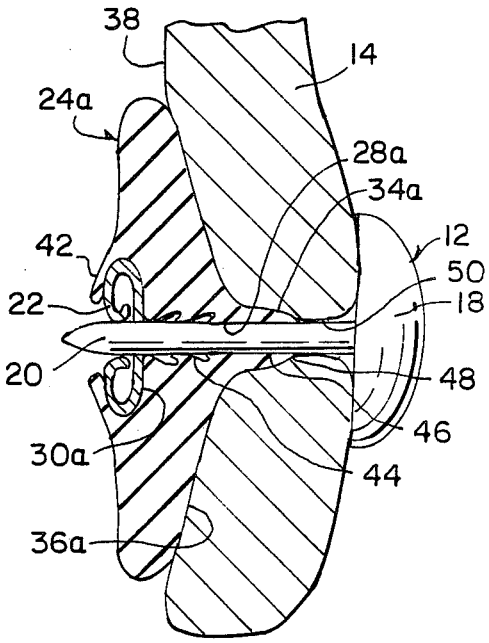
FIG. 4 is an enlarged cross sectional view similar to FIG. 2 showing a modification in which the friction nut is held captive by the rubber holder member to prevent loss thereof.

FIG. 4 shows a modified holder member **24*a* that contains a compartment 42 formed over the depression 30*a* on the rear surface 32*a* to hold captive the friction nut 22 to prevent loss thereof. The central aperture 28*a* has a plurality of gripping ribs 44 to increase clinging power of the holder member 24*a* on the friction post 20. The raised portion 34*a* on the front surface 36*a* is a narrow sleeve 46 that has a tapered distal end 48 so as to be easily inserted within hole 50 of the ear lobe 14 to better position the holder member 24*a* against the rear surface 38 of the ear lobe 14**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A device for preventing loss of a pierced earring from an ear lobe, the pierced earring comprising an ornament, friction post and friction nut, in combination with a holder mounted on said post between the friction nut and the ear lobe, said holder having means for clinging to the friction post thus keeping the pierced earring in place on the ear lobe, should the friction post be removed, wherein said holder is a circular piece of foam rubber having a central aperture therethrough to receive the friction post, a depression formed on a rear surface to receive the friction nut and a raised portion formed on a front surface to increase engagement with the rear surface of the ear lobe, wherein said holder further comprises a compartment formed over the depression on the rear surface to hold captive the friction nut to prevent loss thereof, the central aperture having a plurality of gripping ribs to increase clinging power of said holder member on the friction post and the raised portion on the front surface being a narrow sleeve having a tapered distal end so as to be easily inserted within a hole of the ear lobe to better position said holder member against the rear surface of the ear lobe.

* * * * *